US008708327B2

(12) United States Patent
Suzuki et al.

(10) Patent No.: US 8,708,327 B2
(45) Date of Patent: Apr. 29, 2014

(54) PAPER SHEET HANDLING MACHINE

(75) Inventors: Toshihiko Suzuki, Tokyo-To (JP); Tomoyasu Sato, Tokyo-To (JP); Fumiaki Koga, Tokyo-To (JP)

(73) Assignee: Glory Ltd., Himeji-Shi, Kyogo-Ken (JP)

( * ) Notice: Subject to any disclaimer, the term of this patent is extended or adjusted under 35 U.S.C. 154(b) by 380 days.

(21) Appl. No.: 12/735,408

(22) PCT Filed: Jan. 15, 2009

(86) PCT No.: PCT/JP2009/050420

§ 371 (c)(1),
(2), (4) Date: Jul. 13, 2010

(87) PCT Pub. No.: WO2009/090975

PCT Pub. Date: Jul. 23, 2009

(65) Prior Publication Data

US 2011/0049788 A1 Mar. 3, 2011

(30) Foreign Application Priority Data

Jan. 18, 2008 (JP) ..... 2008-9462

(51) Int. Cl.
*B65H 3/30* (2006.01)

(52) U.S. Cl.
USPC ..... 271/23; 271/130; 271/131; 271/137; 271/165

(58) Field of Classification Search
USPC ..... 271/23, 130, 131, 137, 165
See application file for complete search history.

(56) References Cited

U.S. PATENT DOCUMENTS

| | | | | | |
|---|---|---|---|---|---|
| 911,132 | A | * | 2/1909 | Kleidmann | 271/130 |
| 3,869,116 | A | * | 3/1975 | Kroeker | 271/160 |
| 3,961,785 | A | * | 6/1976 | Gall | 271/119 |
| 4,174,102 | A | * | 11/1979 | Clausing | 271/35 |
| 4,365,793 | A | * | 12/1982 | Van Blokland et al. | 271/3.05 |
| 4,431,358 | A | * | 2/1984 | Jenkner | 414/796 |

(Continued)

FOREIGN PATENT DOCUMENTS

| | | | | | |
|---|---|---|---|---|---|
| JP | 60-026534 | | | 2/1985 | B65H 1/06 |
| JP | 60040337 | A | * | 3/1985 | B65H 1/06 |

(Continued)

OTHER PUBLICATIONS

Chinese Office Action with English Translation (Chinese Application No. 200980102377.5—Issued Apr. 6, 2012) (10 pages).

*Primary Examiner* — Prasad Gokhale
(74) *Attorney, Agent, or Firm* — Renner, Kenner, Greive, Bobak, Taylor & Weber

(57) ABSTRACT

A paper sheet handling machine includes: a storage unit 30 for storing therein paper sheets P in a batch form; a kicker roller 2 for providing drive force to the paper sheet P located in the lowest position, among the paper sheets P in the batch form, by rotating; a gate mechanism 5 for grasping each paper sheet P provided with the drive force by the kicker roller 2, and feeding out the paper sheet P along a feed out plane; and a pressing member 11 for pressing, from above, the paper sheets P stored in the storage unit 30. The gate mechanism 5 includes a feed roller 3 provided to the storage unit 30, and a gate member 4 provided to be opposed to the feed roller 3. Further, a guide roller 10, which is rotatable in a feeding direction of the paper sheets P, is provided to a bottom end of the pressing member 11.

11 Claims, 10 Drawing Sheets

(b)

(56) References Cited

U.S. PATENT DOCUMENTS

| | | | | | |
|---|---|---|---|---|---|
| 4,548,395 | A * | 10/1985 | Snellman et al. | 271/11 |
| 4,557,472 | A * | 12/1985 | Hannon | 271/133 |
| 4,726,724 | A * | 2/1988 | Jenkner | 414/796.8 |
| 4,971,310 | A * | 11/1990 | Motegi et al. | 271/126 |
| 4,988,265 | A * | 1/1991 | Schwab et al. | 414/796.8 |
| 5,083,766 | A * | 1/1992 | Osawa | 271/121 |
| 5,887,867 | A * | 3/1999 | Takahashi et al. | 271/117 |
| 5,967,504 | A * | 10/1999 | Yankloski | 271/2 |
| 6,062,558 | A * | 5/2000 | Takahashi | 271/123 |
| 6,550,761 | B1 * | 4/2003 | Chiang | 271/104 |
| 7,726,643 | B2 * | 6/2010 | Werner | 271/35 |
| 2006/0125173 | A1 * | 6/2006 | Zuzuki et al. | 271/10.11 |
| 2010/0117294 | A1 * | 5/2010 | Maekawa et al. | 271/265.01 |

FOREIGN PATENT DOCUMENTS

| | | | |
|---|---|---|---|
| JP | 62-19328 | 4/1987 | B65H 1/30 |
| JP | 63-67545 | 5/1988 | B65H 1/02 |
| JP | 63-176239 | 7/1988 | B65H 3/52 |
| JP | 63-194840 | 12/1988 | B65H 3/68 |
| JP | 04-313533 | 11/1992 | B65H 3/52 |
| JP | 2001-143001 | 5/2000 | B65H 1/06 |
| WO | WO 2008/096428 A1 * | 8/2008 | B65H 1/24 |

* cited by examiner

PAPER SHEET HANDLING MACHINE

CROSS REFERENCE TO RELATED APPLICATIONS

This application is based on the prior Japanese Patent Application No. 2008-9462 filed on Jan. 18, 2008, the entire contents of which are incorporated herein by reference.

FIELD OF THE INVENTION

The present invention relates to a paper sheet handling machine including a kicker roller adapted for providing drive force to a paper sheet and a pressing member adapted for pressing the paper sheets stored in a storage unit, in a batch form.

BACKGROUND ART

The paper sheet handling machine of the prior art includes the kicker roller adapted for providing the drive force, by rotation thereof, to the paper sheet located in the lowest position, among the paper sheets respectively stored, in the batch form, in a hopper, and a gate mechanism adapted for grasping and feeding out each paper sheet provided with the drive force by the kicker roller.

However, in such a paper sheet handling machine, when abnormal paper sheets, such as folded or creased paper sheets, curled paper sheets and the like, are included in the paper sheets to be handled, it is quite difficult to stably feed out such paper sheets. Thus, an improved paper sheet handling machine, including the pressing member 11, as shown in FIGS. 10(*a*) to 10(*c*), provided for pressing the paper sheets P stored, in the batch form, in the hopper 30, has been used (see Utility-Model No. 1994-1544).

However, even in the case in which such a pressing member 11 is provided, an upper part of the paper sheets P in the batch form may tend to be gradually shifted in position (see FIG. 10(*b*)), due to vibration of the paper sheets P caused by the kicker roller 2 (see an arrow depicted in FIG. 10(*a*)), the stacked condition of the paper sheets P, the shape of each paper sheet P or the like. As such, each paper sheet P will be likely to be fed out in a skewed state, and in some cases, be shifted outside the pressing member 11 (see FIG. 10(*c*)).

SUMMARY OF THE INVENTION

The present invention was made in light of the above problem. Therefore, it is an object of this invention to provide the paper sheet handling machine including the pressing member, which can prevent the paper sheets from shifting outside the pressing member as well as prevent each paper sheet from being fed out in the skewed state.

The paper sheet handling machine of this invention includes:

a storage unit for storing therein paper sheets in a batch form;

a kicker roller provided to the storage unit, for providing drive force to the paper sheet located in the lowest position, among the paper sheets stored in the storage unit, in the batch form, by rotating;

a gate mechanism including a feed roller provided to the storage unit, and a gate member provided to be opposed to the feed roller, the gate mechanism being configured to grasp the paper sheet provided with the drive force by the kicker roller and to feed out the paper sheet along a feed out plane;

a transport mechanism for transporting the paper sheet fed out by the gate mechanism;

a stacking unit for stacking therein the paper sheets transported by the transport mechanism; and a pressing member for pressing, from above, the paper sheets stored in the storage unit, wherein a guide roller is provided for pressing the paper sheets, in a face of the pressing member, the guide roller being rotatable in a feeding direction of the paper sheets.

In the paper sheet handling machine of this invention, it is preferred that the pressing member presses the paper sheets stored in the storage unit, at a point, other than a position just above the kicker roller.

In the paper sheet handling machine of this invention, it is preferred that the pressing member presses the paper sheets stored in the storage unit, on the side closer to the gate mechanism, relative to the kicker roller.

In the paper sheet handling machine of this invention, it is preferred that the pressing member includes a protrusion part protruding downward and configured to press the paper sheets stored in the storage unit.

In the paper sheet handling machine of this invention, it is preferred that protrusion parts press the paper sheets stored in the storage unit, on both sides of the feed roller.

In the paper sheet handling machine of this invention, it is preferred that two or more feed rollers are provided, and that protrusion parts press the paper sheets stored in the storage unit, on both sides of each feed roller.

In the paper sheet handling machine of this invention, it is preferred that a bottom end of each protrusion part is movable to a level below a top end of the feed roller, in a direction vertical to the feed out plane.

In the paper sheet handling machine of this invention, it is preferred that a bottom end of the pressing member is located lower on the side closer to the gate mechanism than on the side closer to the kicker roller, in the direction vertical to the feed out plane, lower than the feed out plane.

In the paper sheet handling machine of this invention, it is preferred that this paper sheet handling machine further includes:

an auxiliary roller provided alongside the feed roller and configured to rotate together with the feed roller; and a pressing roller provided in a position opposite to the auxiliary roller, the pressing roller being rotatable in a feeding direction of the paper sheets, wherein the pressing roller presses the paper sheets stored in the storage unit, between the pressing roller and the auxiliary roller.

In the paper sheet handling machine of this aspect, it is preferred that the pressing roller is driven to rotate.

In the paper sheet handling machine of this invention, it is preferred that the pressing member is reciprocatable between a retracted position and a pressing position, and the pressing member constitutes a part of a side wall of the storage unit, to which the gate member is provided, when the pressing member takes the retracted position, while the pressing member presses, from above, the paper sheets stored in the storage unit, when taking the pressing position.

According to this invention, since a guide roller is provided for pressing the paper sheets, in a face of the pressing member, the guide roller being rotatable in a feeding direction of the paper sheets, there is no frictional force generated between the pressing member and the paper sheets, even in the case in which the upper part of the paper sheets stored in the batch form is somewhat shifted in position, due to the vibration of the paper sheets caused by the drive force given from the kicker roller, the stacked condition of the paper sheets, the shape of each paper sheet or the like. This makes it possible to keep the current position of each paper sheet. Thus, it is possible to prevent the paper sheets from shifting outside the pressing member as well as prevent each paper sheet from being fed out in a skewed state.

DETAILED DESCRIPTION OF THE INVENTION (First Embodiment)

Hereinafter, the first embodiment of the paper sheet handling machine related to the present invention will be described with reference to the drawings. Among the drawings, FIGS. 1 through 7(*a*) and 7(*b*) are respectively provided to illustrate the first embodiment.

Figure 1:
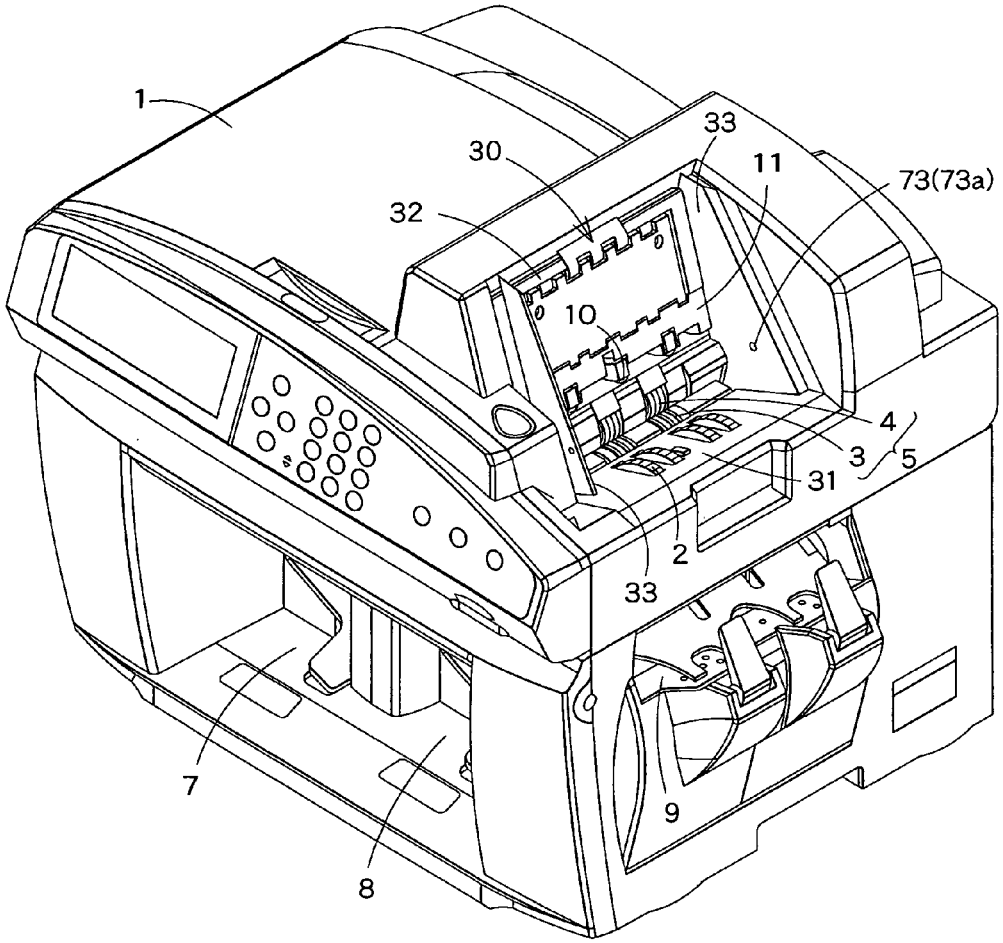
FIG. 1 is a perspective view of the paper sheet handling machine related to a first embodiment of the present invention.
Figure 2:
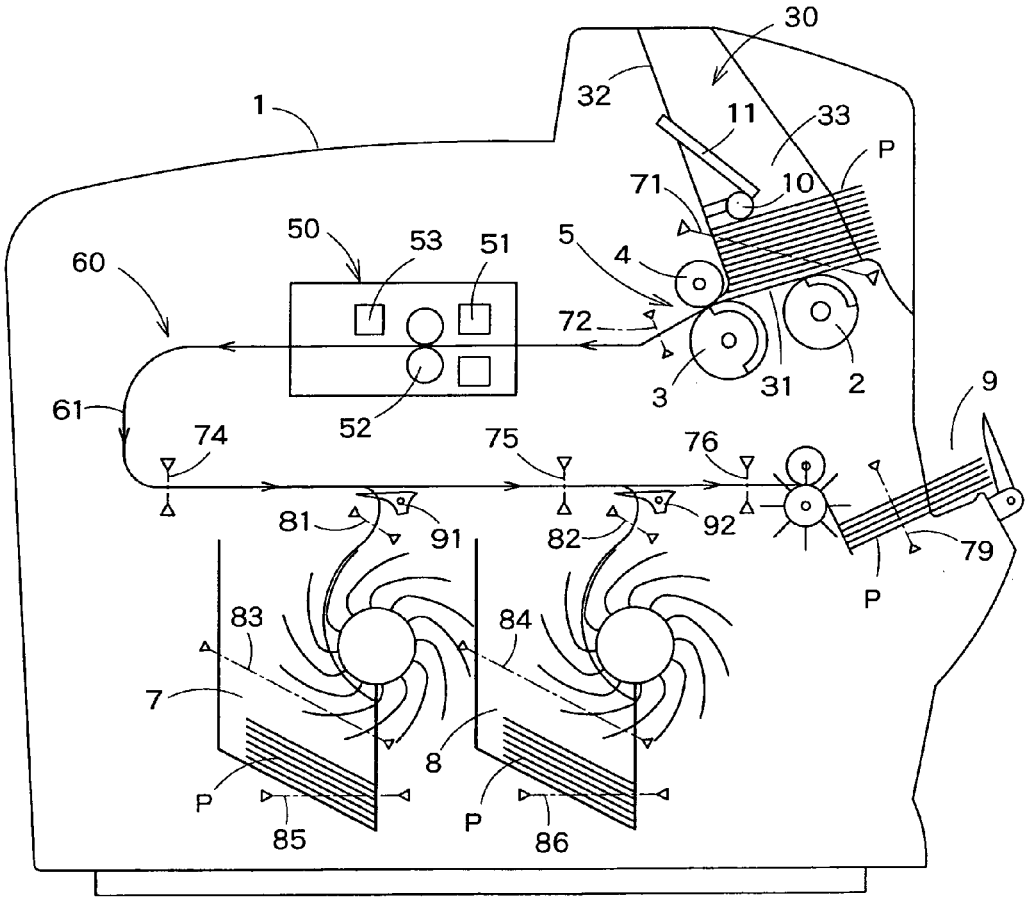
FIG. 2 is a side cross section of the paper sheet handling machine related to the first embodiment of the present invention.

As shown in FIGS. 1 and 2, the paper sheet handling machine includes: a casing 1; the hopper (or storage unit) 30 having a bottom wall 31 and side walls 32, 33 and configured for storing therein the paper sheets P in the batch form; the kicker rollers 2, each configured for providing the drive force to the paper sheet located in the lowest position, among the paper sheets P respectively stored, in the batch form, in the hopper 30; and the gate mechanism 5 adapted for grasping each paper sheet P provided with the drive force by the kicker rollers 2 and then feeding out the paper sheet along the feed out plane.

Although described herein, as bar-code tickets and/or banknotes, by way of example, the paper sheets P are not limited to such articles. Further, in this application, the term "feed out plane" means a plane that is parallel with both of the direction in which each paper sheet P is fed out and the horizontal direction in the plain of this paper sheet P during the feeding operation.

Further, as shown in FIGS. 1 and 2, the gate mechanism 5 includes the feed rollers 3, each provided to the bottom wall 31 of the hopper 30, and the gate rollers (or gate members) 4, each located adjacent to the side wall 32 of the hopper 30 while being opposed to each corresponding feed roller 3.

Figure 4:
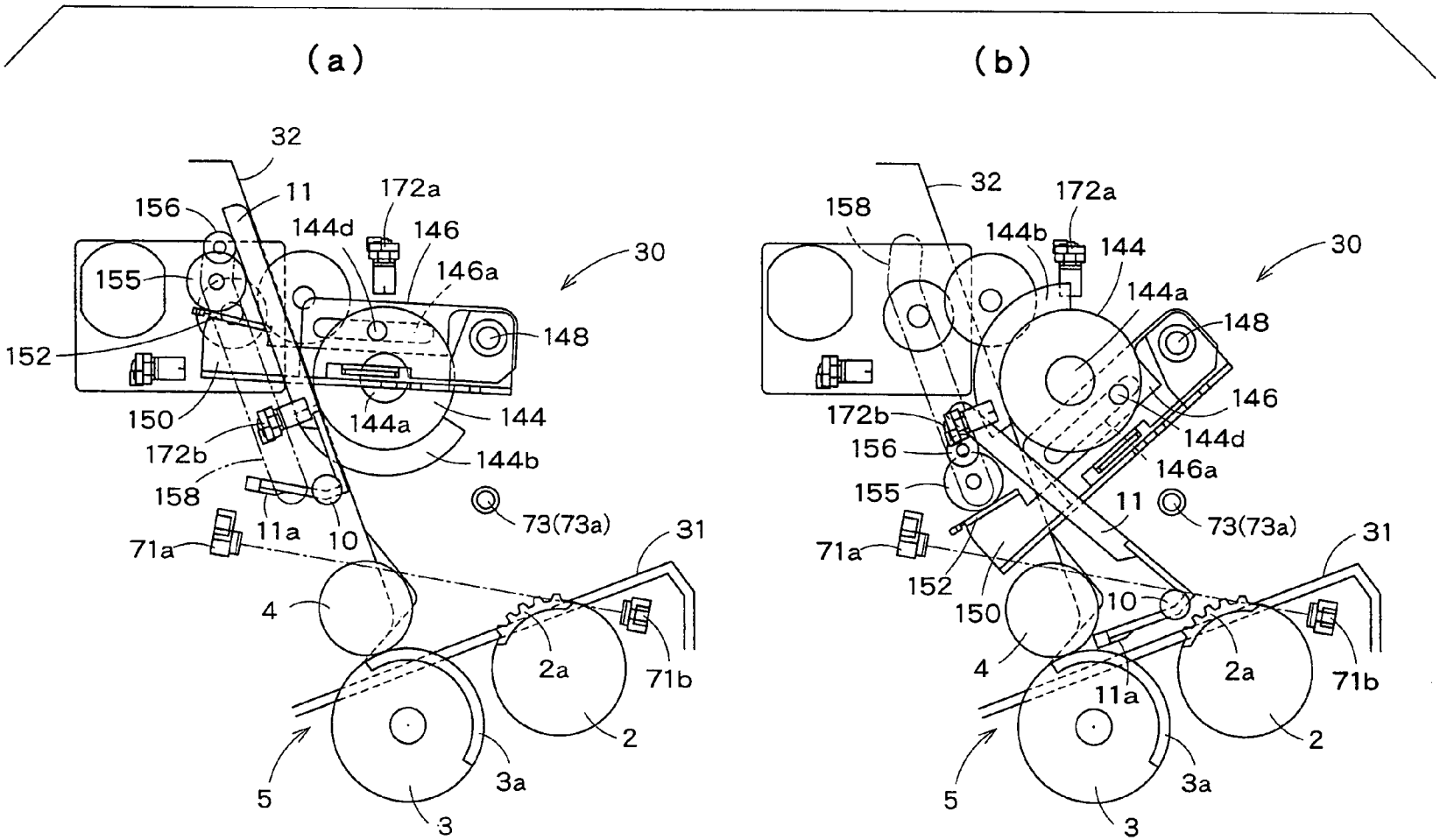
FIG. 4 is an enlarged side cross section showing one aspect for driving the pressing member of the paper sheet handling machine related to the first embodiment of the present invention.

As shown in FIGS. 4(*a*) and 4(*b*), a high friction member 2*a* is provided to a part of the periphery of each kicker roller 2, with the coefficient of friction thereof being higher than the other part of the kicker roller 2. Similarly, another high friction member 3*a* is provided to a part of the periphery of each feed roller 3, with the coefficient of friction thereof being higher than the other part of the feed roller 3.

Further, as shown in FIG. 2, the transport mechanism 60 configured for transporting each paper sheet P fed out by the gate mechanism 5 is provided in the casing 1, on the downstream side relative to the gate mechanism 5. Additionally, on the downstream side relative to the transport mechanism 60 in the casing 1, stackers (or stacking units) 7, 8 are provided for respectively stacking therein the paper sheets P transported by the transport mechanism 60. Further, on the downstream side relative to the transport mechanism 60, a reject unit 90 is also provided for stacking therein the paper sheets P that are not stacked in any of the stackers 7, 8.

As shown in FIGS. 1 and 2, the stackers 7, 8 are respectively composed of a bar-code ticket stacker 7 for storing therein the bar-code tickets, and a banknote stacker 8 for storing therein the banknotes. Further, as shown in FIG. 2, the transport mechanism 60 includes a transport path 61 configured for guiding the paper sheets P and transport rollers (not shown) configured for providing the drive force to each paper sheet P.

In addition, as shown in FIG. 2, a stack detection sensor 85, for detecting whether or not the bar-code tickets are stacked, is provided to the bar-code ticket stacker 7, while another stack detection sensor 86, for detecting whether or not the banknotes are stacked, is provided to the banknote stacker 8. Similarly, still another stack detection sensor 79, for detecting whether or not the paper sheets P that are not guided into any of the bar-code ticket stacker 7 and banknote stacker 8 are stacked, is provided to the reject unit 9.

Further, as shown in FIG. 2, sensors 74, 75, 76, 81 and 82, respectively adapted for detecting whether or not each paper sheet P is passed through the transport path 61, are provided to various points along the transport path 61. Furthermore, as shown in FIG. 2, a sensor 83 for detecting the existence of the bar-code tickets is provided to the bar-code ticket stacker 7, while another sensor 84 for detecting the existence of the banknotes is provided to the banknote stacker 8. In addition, along the transport path 61, a diverter 91 is provided between the recognition unit 50 which will be detailed later and the bar-code ticket stacker 7, while another diverter 92 is provided between the diverter 91 and the banknote stacker 8.

Now, referring to FIG. 2, the recognition unit 50 adapted for recognizing each paper sheet P is provided in the casing 1. This recognition unit 50 includes a line sensor 51 adapted for reading an image of each paper sheet P, a thickness sensor 52 adapted for reading the thickness of each transported paper sheet P, and a magnetic sensor 53 adapted for reading the information as to magnetism on each paper sheet P.

Figure 3:
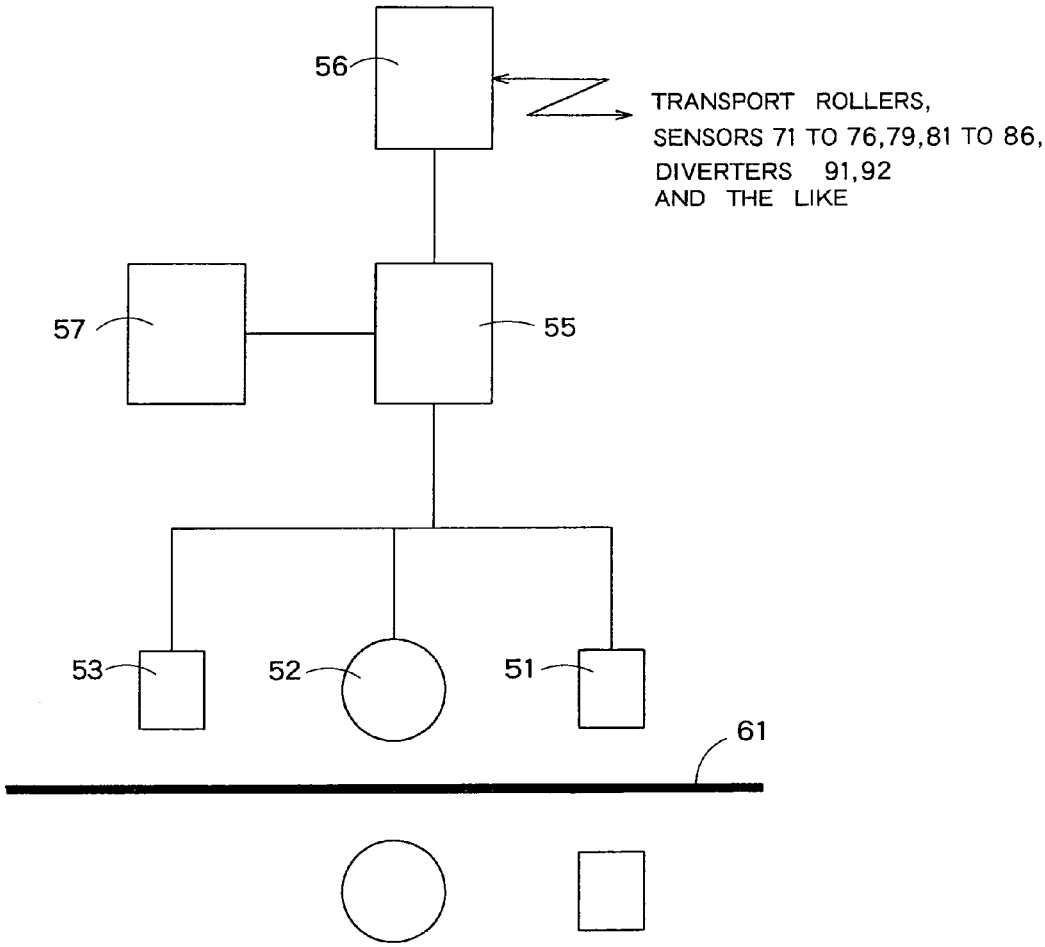
FIG. 3 is a schematic diagram showing the internal construction of a recognition unit of the paper sheet handling machine related to the first embodiment of the present invention.

As shown in FIG. 3, the line sensor 51, the thickness sensor 52 and the magnetic sensor 53 are respectively connected with a recognition CPU 55 adapted for recognizing new or old version, fitness, authentication, denomination, orientation, face/back or the like of each banknote. This recognition CPU 55 is in turn connected with a control CPU 56 connected with the transport rollers, sensors 71 to 76, 79, 81 to 86, diverters 91, 92 and the like (however, it is noted that this control CPU 56 may not be provided in the recognition unit 50). The control CPU 56 is configured to control the driving of each of the transport rollers, sensors 71 to 76, 79, 81 to 86, diverters 91, 92 and the like, based on the recognition information provided from the recognition CPU 55. The sensors 71, 72 and 73 will be described later.

Further, as shown in FIG. 3, a bar-code CPU 57 is connected with the recognition CPU 55. This bar-code CPU 57 is provided for receiving image data of each bar-code ticket read by the line sensor 51, via the recognition CPU 55, and then recognizing bar-code information of the bar-code ticket.

Again, referring to FIGS. 1 and 2, the pressing member 11 is provided to the side wall 32 of the hopper 30. This pressing member 11 is configured for pressing, from above, the paper sheets P stored in the hopper 30. Further, the pressing member 11 has the guide rollers 10, each provided in a face of the pressing member 11, for pressing the paper sheets P (see FIG. 5). Each guide roller 10 can be rotated in the feeding direction of the paper sheets P. As shown in FIGS. 4(*a*), 4(*b*) and 5, the pressing member 11 includes the protrusion parts 11*a*, each protruding downward at the bottom end of the pressing member 11 and adapted for pressing the paper sheets P stored in the hopper 30.

The pressing member 11 can be reciprocated between the retracted position and the pressing position thereof (see FIGS. 4(*a*), 4(*b*)). The pressing member 11 constitutes one part of the side wall 32 of the hopper 30, when it takes the retracted position thereof (see FIG. 4(*a*)), while this member 11 can press, from above, the paper sheets P stored in the hopper 30, when taking the pressing position thereof (see FIG. 4(*b*)).

Further, as shown in FIG. 4(*b*), when the pressing member 11 is in the pressing position thereof, the pressing member 11 can serve to press the paper sheets P stored in the hopper 30, via each protrusion part 11*a*, at the point, other than the position just above each kicker roller 2. Specifically, each protrusion part 11*a* of the pressing member 11 can press the paper sheets P stored in the hopper 30, on the side closer to the gate mechanism 5, relative to the kicker roller 2. More specifically, the protrusion parts 11*a* of the pressing member 11 are provided, at three points, wherein such three protrusion parts 11*a* can respectively press downward the paper sheets P stored in the hopper 30, on both sides of each of two feed rollers 3 (see FIGS. 6(*a*), 6(*b*) and FIGS. 7(*a*), 7(*b*)). In this application, the term "both sides" means the both sides of a component in the feed out plane.

Figure 6:
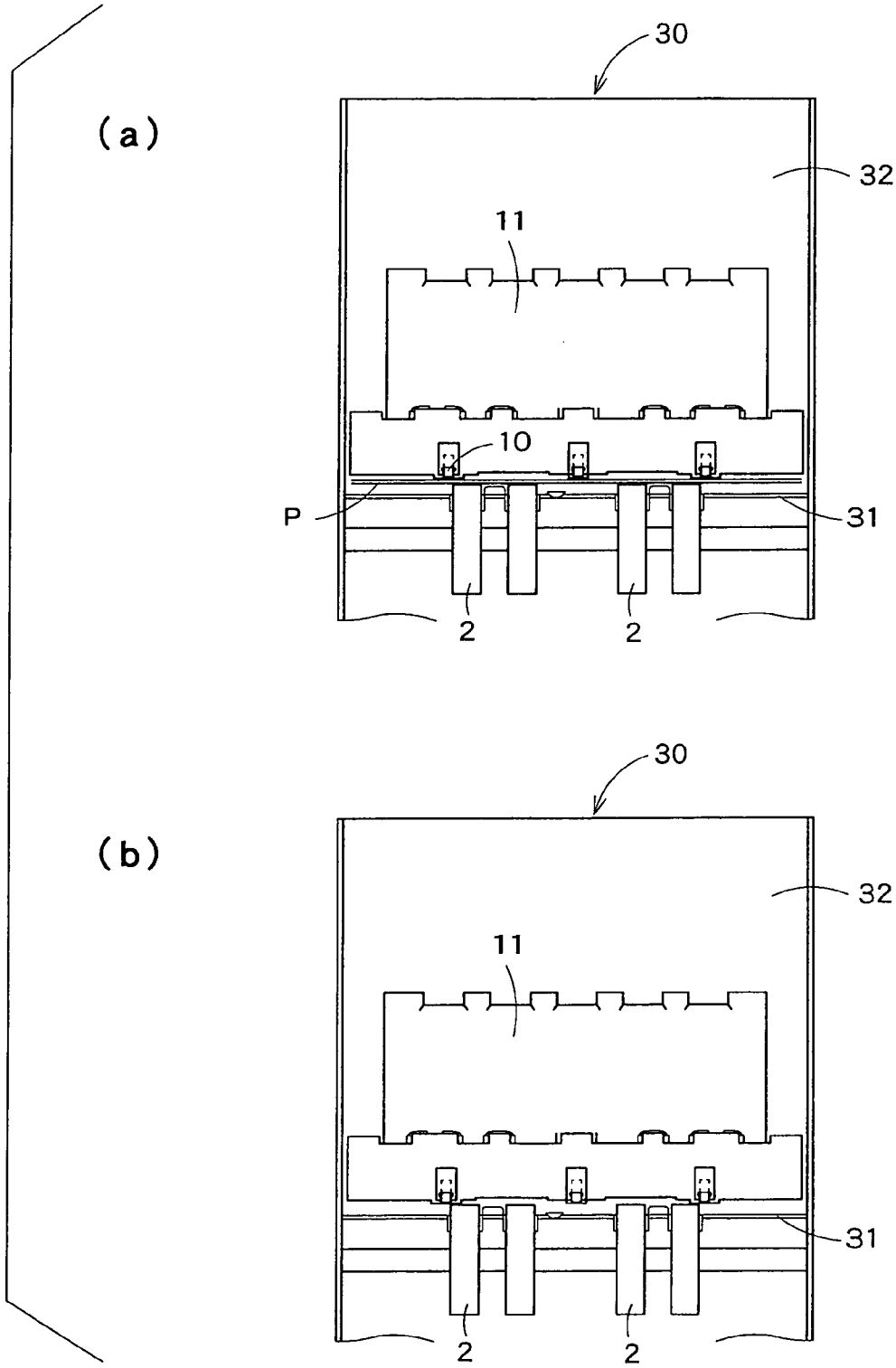
FIG. 6 is a front view showing a relationship between each guide roller and each kicker roller of the paper sheet handling machine related to the first embodiment of the present invention.
Figure 7:
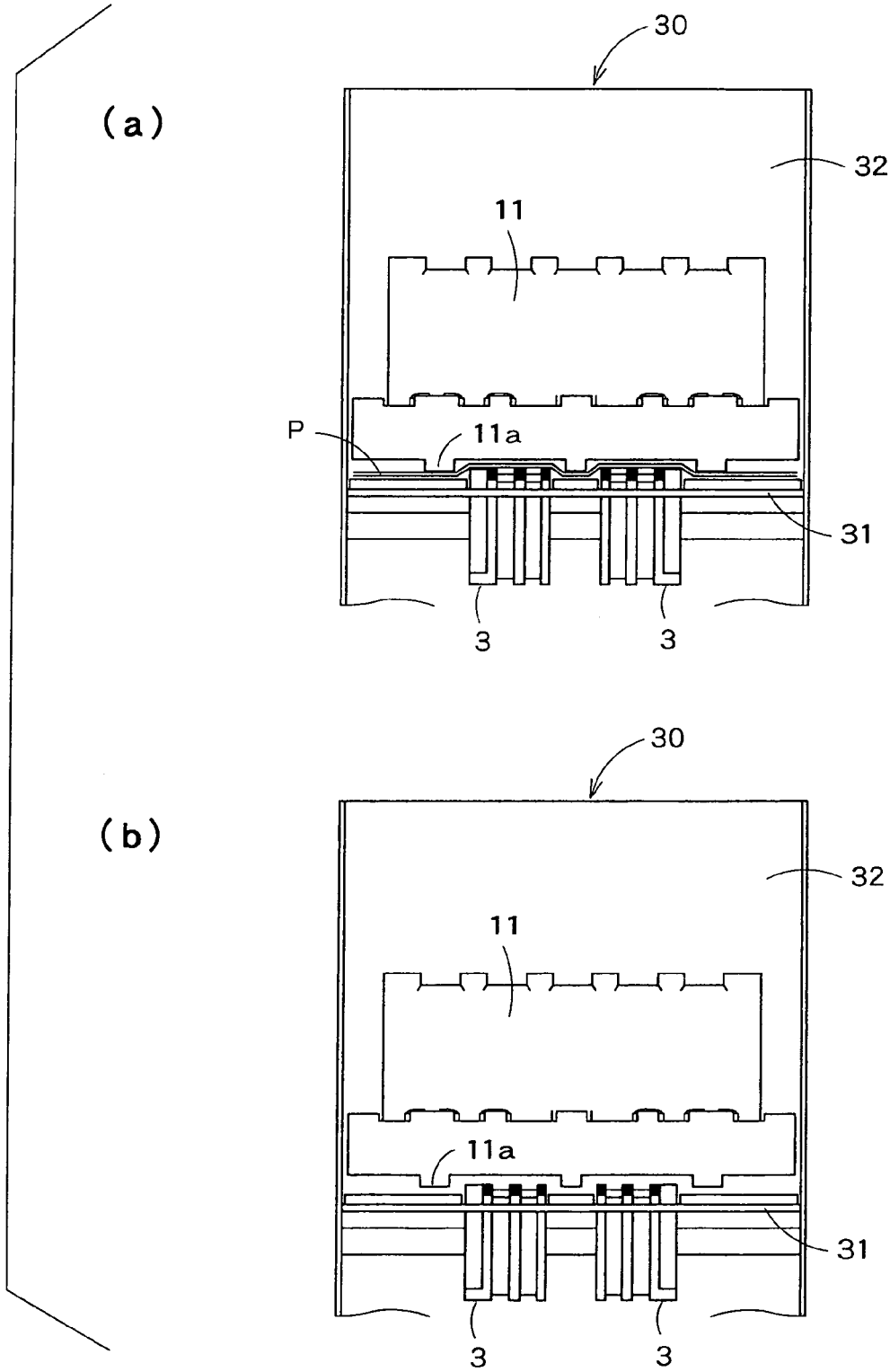
FIG. 7 is a front view showing a relationship between each protrusion part and each feed roller of the paper sheet handling machine related to the first embodiment of the present invention.

FIGS. 6(*a*), 6(*b*) are the front views, respectively showing the relationship between each guide roller 10 and each kicker roller 2. FIGS. 7(*a*), 7(*b*) are the front views, respectively showing the relationship between each protrusion part 11*a* and each feed roller 3. In each drawing of FIGS. 6(*a*), 6(*b*) and FIGS. 7(*a*), 7(*b*), (although not actually seen in such front views,) a part of the shape of each kicker roller 2 and a part of the shape of each feed roller 3, respectively hidden, in fact, under the bottom wall 31, are also depicted.

FIGS. 6(*a*) and 7(*a*) respectively show a state in which the paper sheets P are stored in the hopper 30, while FIGS. 6(*b*) and 7(*b*) respectively show another state in which the paper sheets P are not stored in the hopper 30.

As is seen from FIGS. 6(*a*) and 7(*a*), the paper sheets P are not pressed by the guide rollers 10, but pressed by the protrusion parts 11*a*.

The bottom end of each protrusion part 11*a* of the pressing member 11 is movable to a level below the top end of each feed roller 3, in the direction vertical to the feed out plane. Therefore, as the amount of the paper sheets P remaining in the hopper 30 is decreased, the bottom end of each protrusion part 11*a* of the pressing member 11 will be movable to a level below the top end of each feed roller 3, in the direction vertical to the feed out plane (see FIGS. 7(*a*), 7(*b*)). Thus, the paper sheets P can be securely grasped between the protrusion parts 11*a* and the feed rollers 3.

Further, the bottom end of the pressing member 11 is located lower on the side closer to the gate mechanism 5 than on the side closer to the kicker roller 2, as well as located below a bottom end of each guide roller 10 provided to the pressing member 11, in the direction vertical to the feed out plane (see FIGS. 4(*a*), 4(*b*), 6(*a*), 6(*b*), 7(*a*) and 7(*b*)). In this case, it is noted that the paper sheets P are not grasped between the guide rollers 10 and kicker rollers 2 (see FIG. 6(*a*)).

Further, as shown in FIG. 2, the feed-out detection sensor 72, adapted for detecting that the paper sheets P are securely fed out by the feed rollers 3 and gate rollers 4, is provided on the downstream side relative to these rollers 3 and 4.

As shown in FIGS. 1, 4(*a*) and 4(*b*), the storage-amount detection sensor 73 is provided to the side wall 33 of the hopper 30. This sensor 73 can serve to transmit a signal to the control CPU 56 (see FIG. 3), when the height of the batch of the paper sheets P stored in the hopper 30 is equal to or lower than a predetermined height thereof. Specifically, this storage-amount detection sensor 73 includes a light-emission part 73*a* and a light-receiving part (not shown) for receiving the light emitted from the light-emission part 73*a*. Thus, when the light emitted from the light-emission part 73*a* is received by the light-receiving part, the sensor 73 can transmit the signal, which is indicative of the fact that the height of the batch of the paper sheets P stored in the hopper 30 is equal to or lower than the predetermined height thereof, to the control CPU 56. It is noted that only the light-emission part 73*a* of the storage-amount detection sensor 73 is illustrated in FIGS. 1, 4(*a*) and 4(*b*).

Further, as shown in FIGS. 2, 4(*a*) and 4(*b*), the sensor 71 that can serve to detect whether or not the paper sheets P are stored in the hopper 30 is provided in both of the side wall 32 and bottom wall 31 of the hopper 30. More specifically, a light-emission part 71*a* is provided in the side wall 32 of the hopper 30, while a light-receiving part 71*b* adapted for receiving the light emitted from the light-emission part 71*a* is provided in the bottom wall 31 of the hopper 30.

As shown in FIGS. 4(*a*), 4(*b*), the mechanism for driving the pressing member 11 includes a first cam 144 configured to be rotatable about an axis 144*a* and including a guide pin 144*d*, a second cam 146 configured to be rotatable about an axis 148 and including a guide groove 146a for guiding the guide pin 144*d*, and a third cam 150 configured to be rotatable about the axis 148 together with the second cam 146 and including a support plate 152 for supporting push-up rollers 155 described below.

Figure 5:
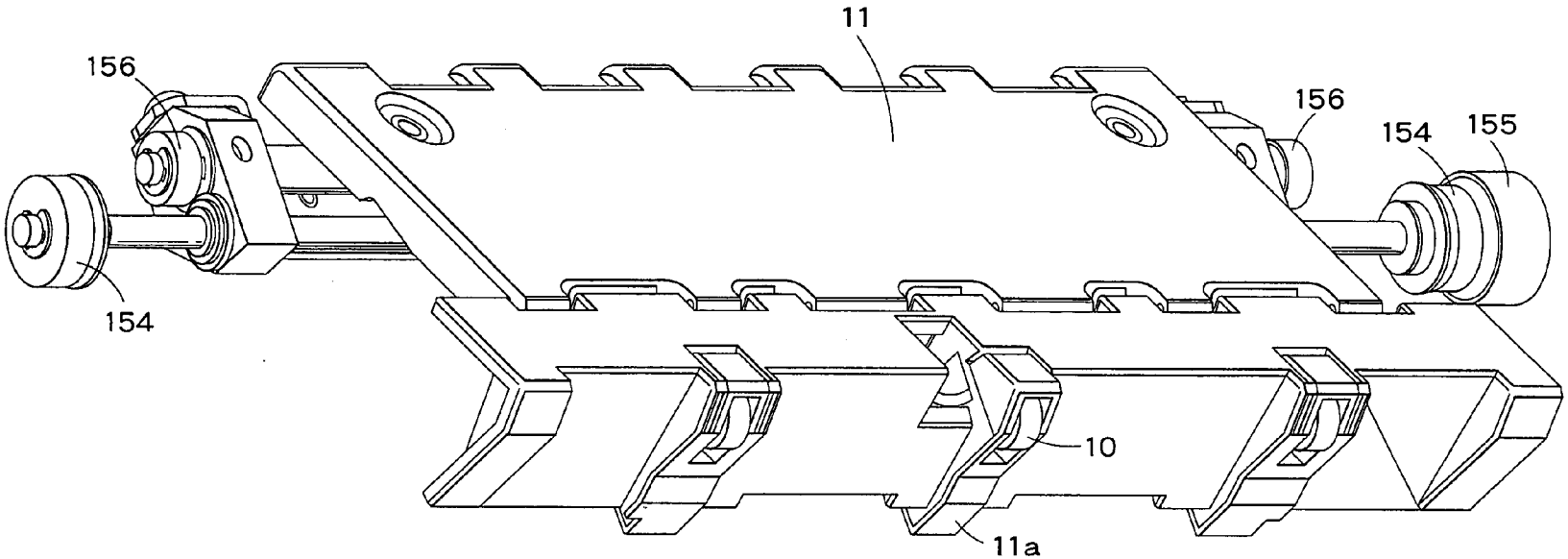
FIG. 5 is a perspective view of the pressing member of the paper sheet handling machine related to the first embodiment of the present invention.

In addition, as shown in FIGS. 4(*a*), 4(*b*), guide grooves 158 respectively configured for guiding lower guide rollers 154 (see FIG. 5) are provided in the side wall 32 of the hopper 30. As shown in FIG. 5, the lower guide rollers 154 are provided, respectively, on both sides of the pressing member 11. Further, upper guide rollers 156 are provided, respectively above the lower guide rollers 154, on both sides of the pressing member 11. In this case, as shown in FIG. 5, each push-up roller 155 is provided outside each lower guide roller 154.

Further, as shown in FIGS. 4(*a*), 4(*b*), a rotation detector 144*b* is provided around a part of the periphery of the first cam 144. Additionally, two sensors 172*a*, 172*b*, each adapted for detecting the rotation detector 144*b*, when the pressing member 11 reaches the pressing position thereof, are provided, respectively, in the side walls 32, 33 of the hopper 30.

Now, the operation of this embodiment constructed as described above will be discussed.

First, the paper sheets P in the batch form of the bar-code tickets and/or banknotes are placed in the hopper 30. At this time, the paper sheets P in the batch form are guided along the respective side walls 32, 33 of the hopper 30 (see FIGS. 1 and 2). In this embodiment, since the pressing member 11, when taking the retracted position thereof, constitutes the part of the side wall 32 of the hopper 30, the storage of the paper sheets P in the batch form into the hopper 30 is not obstructed, in any way, by such a pressing member 11.

Hereinafter, one aspect, in which one paper sheet P is transported, will be described, by way of example.

Once the paper sheets P are stored in the hopper 30, the kicker rollers 2 are respectively driven to rotate, thereby to provide the drive force to the one paper sheet P located in the lowest position, among the paper sheets P stored in the hopper 30, in the batch form (see FIGS. 1, 2 and 4(*a*)).

Then, this paper sheet P provided with the drive force by the kicker rollers 2 will be grasped between the feed rollers 3 and the gate rollers 4 of the gate mechanism 5, so as to be fed out along the feed out plane (see FIGS. 1, 2 and 4(*a*)). At this time, the feed-out detection sensor 72 detects that the paper sheet P is securely fed out (see FIG. 2). In this manner, since each paper sheet P can be grasped between the feed rollers 3 and the gate rollers 4, the feed out operation for the paper sheets P can be controlled, such that these paper sheets P can be fed out, one by one, from the gate mechanism 5.

Thereafter, the paper sheet P that has been fed out by the feed rollers 3 and gate rollers 4 is transported by the transport mechanism 60 (see FIG. 2).

In this manner, the paper sheet P transported by the transport mechanism 60 is passed through the recognition unit 50 (see FIG. 2). Then, in the recognition unit 50, new or old version, fitness, authentication, denomination, orientation, face/back or the like of each banknote, and/or bar-code information on each bar-code ticket is recognized. In this case, the thickness sensor 52 of the recognition unit 50 can serve to detect whether or not the paper sheet P is transported while being overlapped with one or more paper sheets P (i.e., overlap transportation).

When the recognition unit 50 recognizes no recognition abnormality on the paper sheet P, while no transportation abnormality is found during the transportation of the paper sheet P performed by the transport mechanism 60, this paper sheet P that has been fed out by the gate mechanism 5 will be guided toward each stacker 7, 8 and then stacked therein (see FIG. 2). At this time, the bar-code ticket is stacked in the bar-code ticket stacker 7, while the banknote is stacked in the banknote stacker 8.

Meanwhile, when some recognition abnormality on the paper sheet P is recognized by the recognition unit 50, or when some transportation abnormality is found during the transportation of the paper sheet P performed by the transport mechanism 60, such a paper sheet P that has been fed out by the gate mechanism 5 will be transported toward the reject unit 9 and then stacked therein (see FIG. 2).

As used herein, the term "recognition abnormality" means an event or case in which some information recognized by the recognition unit 50 is not identified with the corresponding information stored in advance in this unit 50. For instance, as the recognition abnormality, the case in which some bar-code information recognized by the recognition unit 50 is not identified with the corresponding information stored in advance in the unit 50, the case in which a certain kind of the banknote recognized by the recognition unit 50 is different from the information on the corresponding banknote stored in advance in this unit 50, and the like can be mentioned. By the way, such information stored in advance in the recognition unit 50 can be altered as needed. For instance, when the kind of the banknotes to be handled is changed, when the kind of the bar-code tickets to be handled is changed, or the like, the information on such banknotes and/or bar-code tickets can be altered, appropriately.

Further, the term "transportation abnormality" means some abnormality found or detected when each paper sheet P is transported by the transport mechanism 60. For instance, as the transportation abnormality, the case in which each paper sheet P is transported in the skewed state (i.e., skewed transportation), the case in which the plurality of paper sheets P are transported while being overlapped one on another (i.e., overlap transportation), the case in which the plurality of paper sheets P are transported without any interval therebetween (i.e., chain transportation), and the like can be mentioned.

In this case, the paper sheets P are diverted and sorted, by each of the diverters 91, 92, toward each of the bar-code ticket stacker 7, banknote stacker 8 and reject unit 9 (see FIG. 2). More specifically, each bar-code ticket is transported toward the bar-code ticket stacker 7 by the diverter 91, while each banknote is transported toward the banknote stacker 8 by the diverter 92, after detected by the sensor 75. Further, each paper sheet P that is not transported to any of the bar-code ticket stacker 7 and banknote stacker 8 will be transported to the reject unit 9 through the sensor 76.

For each bar-code ticket that is transported to the bar-code ticket stacker 7, the sensor 81 detects that the bar-code ticket is transported into the bar-code ticket stacker 7, when this bar-code ticket is passed through the sensor 81. Meanwhile, for each banknote that is transported to the banknote stacker 8, the sensor 82 detects that the banknote is transported into the banknote stacker 8, when this banknote is passed through the sensor 82.

With a series of such steps as described above, the transportation of each paper sheet P is completed. Further, with repetition of such a series of those steps, the amount of the paper sheets P stored in the hopper 30 will be gradually decreased. In this manner, when the storage-amount detection sensor 73 detects that the height of the batch of the paper sheets P stored in the hopper 30 is equal to or lower than the predetermined height thereof, the signal indicative of this detection result will be transmitted to the control CPU 56 (see FIG. 3). Then, in response to the signal that is in turn transmitted from the control CPU 56, the pressing member 11 that has constituted the part of the side wall 32 of the hopper 30 (or has taken the retracted position thereof) will be moved to the pressing position thereof (see FIGS. 4(*a*), 4(*b*)).

More specifically, in FIG. 4(*a*), the first cam 144 is rotated in the anticlockwise direction about the axis 144*a*. At this time, the guide pin 144*d* of the first cam 144 is also rotated in the anticlockwise direction about the axis 144*a*. Thus, the guide pin 144*d* is guided along the guide groove 146*a* of the second cam 146. As a result, the second cam 146 is rotated in the anticlockwise direction about the axis 148. Then, the third cam 150 is rotated in the anticlockwise direction about the axis 148, together with the second cam 146, while the support plate 152 supporting the push-up rollers 155 is moved downward.

In this way, when the support plate 152 is moved downward, each lower guide roller 154 is also moved downward, while being guided along the guide groove 158. Therefore, each lower guide roller 154 and each corresponding upper guide roller 156 are moved downward together, until the lower guide roller 154 reaches a bottom end of the guide groove 158 (see FIG. 4(*b*)). At this time, one end of the pressing member 11, at which the guide rollers 10 are provided, is pushed out toward the inside of the hopper 30. In this manner, the pressing member 11 reaches the pressing position thereof. Consequently, when the rotation detector 144*b* of the first cam 144 is detected by the two sensors 172*a*, 172*b*, the pressing member 11 is judged to have reached the pressing position thereof, and then the actuation of the first cam 144 is stopped by the signal given from the control CPU 56.

As shown in FIGS. 2, 4(*a*), 4(*b*) and 5, the guide rollers 10, which are rotatable in the feeding direction of each paper sheet P, are provided at the bottom end of the pressing member 11. Such guide rollers 10 can prevent undue frictional force from being exerted on the uppermost paper sheet P of the paper sheets P stored in the batch form. Therefore, even if the part of the paper sheets P stored in the batch form is somewhat shifted in position, due to the vibration of the paper sheets P caused by the drive force provided from the kicker rollers 2, the stacked condition of the paper sheets P, the shape of each paper sheet P or the like, the position of such a shifted part of the paper sheets P can be adequately kept as it is (or even returned to the original or initially stored position thereof), because there is no frictional force exerted thereon from the pressing member 11. Thus, it is possible to prevent the paper sheets P from shifting outside the pressing member 11, as well as prevent the paper sheets P from being fed out in the skewed state.

In this way, the above configuration can successfully prevent the paper sheets P from being rather shifted outside the pressing member 11, and thus can allow such paper sheets P in the batch form to be handled continuously. Further, since this configuration can effectively prevent the paper sheets P from being fed out in the skewed state, an unwanted jam of the paper sheets P on the transport path 61 can be well avoided. In addition, since the pressing member 11 can adequately press the paper sheets P, each kicker roller 2 can steadily provide the drive force to each paper sheet P, thereby substantially increasing the number of the paper sheets P that can be handled in a given time.

In this manner, as the paper sheets P are fed out toward the transport path 61 in succession, and hence the amount of the paper sheets P pressed downward by the pressing member is decreased, each protrusion part 11*a* of the pressing member 11 will be moved to a level below the upper end of each feed roller 3, in the direction vertical to the feed out plane, as shown in FIGS. 7(*a*), 7(*b*). Thus, protrusion part 11*a* of the pressing member 11 can grasp the paper sheets P between the protrusion part 11*a* and the feed roller 3, therefore can securely grasp the paper sheets P.

Further, as shown in FIGS. 7(*a*), 7(*b*), since the protrusion parts 11*a* of the pressing member 11 respectively press downward the paper sheets P stored in the hopper 30, on both side of each feed roller 3 (e.g., at the three points), the paper sheets P can be grasped, more securely, between such protrusion parts 11*a* and feed rollers 3.

With such secure grasping of the paper sheets P between the protrusion parts 11*a* and the feed rollers 3, such an unwanted event that the paper sheets P are shifted outside the pressing member 11 and/or each paper sheet P is skewedly fed out can be prevented more securely.

Furthermore, as shown in FIGS. 4(*a*), 4(*b*), 6(*a*), 6(*b*), 7(*a*) and 7(*b*), the bottom end of the pressing member 11 is located below the bottom end of each guide roller 10 provided to the pressing member 11, in the direction vertical to the feed out plane. Therefore, each point, at which the pressing force is substantially applied onto the paper sheets P, can be limited to each protrusion part 11*a* located on the side closer to each feed roller 3, thereby effectively reducing (or eliminating) the pressing force that may be applied onto the paper sheets P from each guide roller 10.

Thus, inadvertent application of undue frictional force onto the paper sheets P from each guide roller 10 can be prevented more securely, thereby preventing, further securely, the paper sheets P from shifting outside the pressing member 11, as well as preventing, further securely, the paper sheets P from being fed out in the skewed state.

As described above, once all of the paper sheets P including the bar-code tickets and/or banknotes stored in the hopper 30 are fed out from the hopper 30, and transported toward the bar-code ticket stacker 7, banknote stacker 8 and reject unit 9, and then stacked therein, respectively, one cycle for handling such paper sheets P in the batch form stored in the hopper 30 is ended. It is noted that the fact that the paper sheets P are all fed out from the hopper 30 is detected by the sensor 71, when the light-receiving part 71*b* of this sensor 71 receives the light emitted from the light-emission part 71*a* thereof.

(Second Embodiment)

Figure 8:
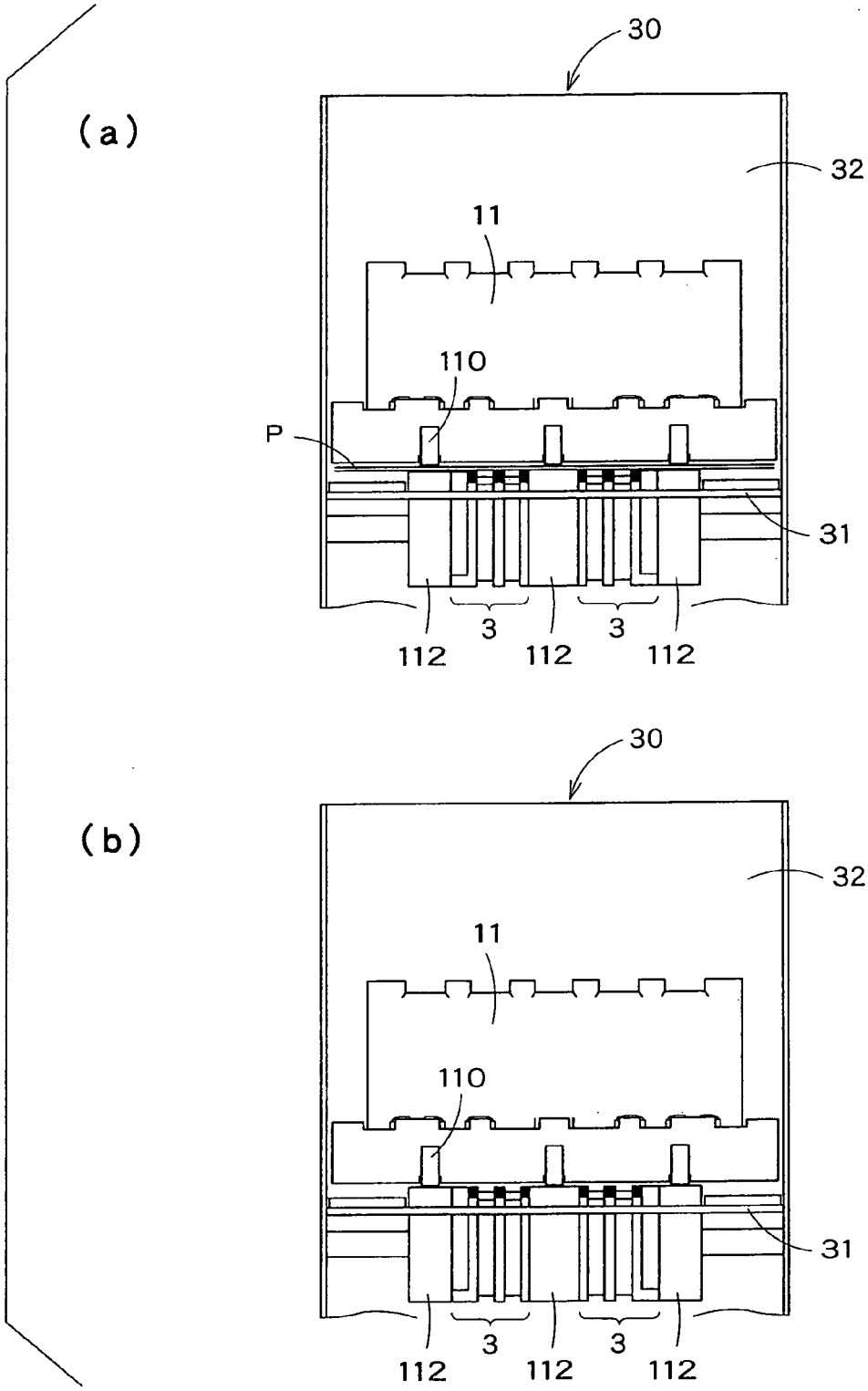
FIG. 8 is a front view showing a relationship between each pressing roller and each auxiliary roller of the paper sheet handling machine related to a second embodiment of the present invention.
Figure 9:
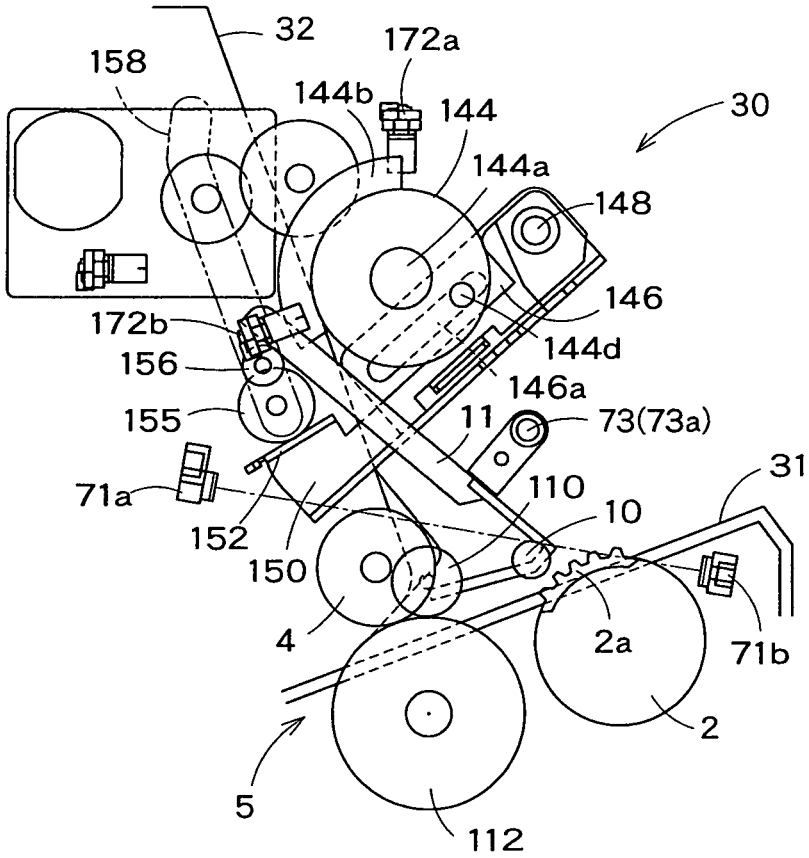
FIG. 9 is an enlarged side cross section showing a part in the vicinity of the pressing member of the paper sheet handling machine related to the second embodiment of the present invention.
Figure 10:
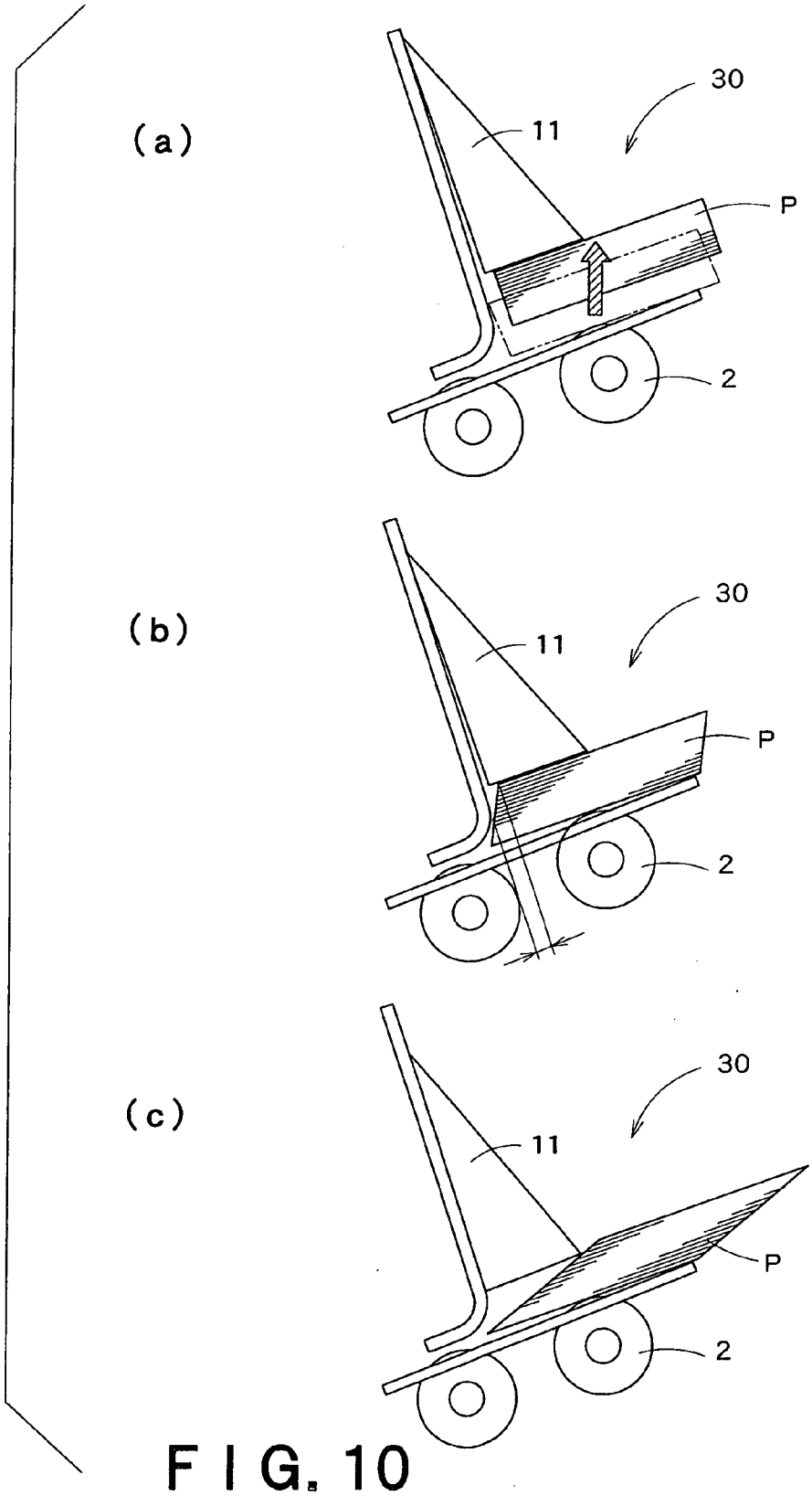
FIG. 10 is an enlarged side cross section showing the part in the vicinity of the pressing member of the paper sheet handling machine of the prior art.

Now, referring to FIGS. 8(*a*), 8(*b*) and 9, the second embodiment of the present invention will be described. As shown in FIGS. 8(*a*), 8(*b*) and 9, this second embodiment includes the auxiliary rollers 112, each provided alongside each feed roller 3 and configured to be rotated together with the feed roller 3. Further, in place of the protrusion parts 11*a*, the pressing rollers 110, respectively rotatable in the feeding direction of the paper sheets P, are provided to the bottom end of the pressing member 11. The other constructions are substantially the same as the construction of the above first embodiment shown in FIGS. 1 through 7(*a*) and 7(*b*).

In the second embodiment shown in FIGS. 8(*a*), 8(*b*) and 9, like parts or components included in the first embodiment shown in FIGS. 1 through 7(*a*) and 7(*b*) are designated by like reference numerals, and the description on such parts will be omitted below.

As shown in FIGS. 8(*a*), 8(*b*), three auxiliary rollers 112 are respectively arranged on both sides of each of the two feed rollers 3, such that each auxiliary roller 112 can be rotated together with each adjacent feed roller 3. Further, three pressing rollers 110, respectively rotatable in the feeding direction of the paper sheets P, are provided at the bottom end of the pressing member 11, in each position opposite to each corresponding auxiliary roller 112. In this case, each auxiliary roller 112 has a diameter substantially the same as the diameter of each feed roller 3, and is composed of a low friction member exhibiting, over the whole periphery thereof, the frictional force lower than that of each feed roller 3.

In this embodiment, as described above, each auxiliary roller 112 can be rotated together with each feed roller 3, while each pressing roller 110 rotatable in the feeding direction of the paper sheets P is provided at the bottom end of the pressing member 11, in the position opposite to each corresponding auxiliary roller 112. Therefore, the paper sheets P stored in the hopper 30 can be grasped between pressing rollers 110 and auxiliary rollers 112, therefore the paper sheets P can be grasped more securely. Thus, this configuration can prevent, further securely, the paper sheets P from shifting outside the pressing member 11, as well as preventing, further securely, the paper sheets P from being fed out in the skewed state.

It should be appreciated that the second embodiment can also provide other effects similar to the effects that can be provided by the first embodiment.

While the second embodiment has been merely described and shown as one aspect, in which each pressing roller 110 is rotatable in the feeding direction of the paper sheets P, the pressing roller 110 may be driven to rotate in the feeding direction of the paper sheets P, for example, by a proper drive unit, such as a motor or the like. Further, in this case, it is preferred that each pressing roller 10 can be rotated in synchronism with the rotation of each feed roller 3.

The invention claimed is:

1. A paper sheet handling machine, comprising:

a storage unit for storing therein paper sheets in a batch form;

two or more kicker rollers provided to the storage unit, for providing drive force to the paper sheet located in the lowest position, among the paper sheets stored in the storage unit, in the batch form, by rotating;

a gate mechanism including a feed roller provided to the storage unit, and a gate member provided to be opposed to the feed roller, the gate mechanism being configured to grasp the paper sheet provided with the drive force by the kicker roller and to feed out the paper sheet along a feed out plane;

a transport mechanism for transporting the paper sheet fed out by the gate mechanism;

a stacking unit for stacking therein the paper sheets transported by the transport mechanism; and a pressing member for pressing, from above, the paper sheets stored in the storage unit, wherein guide rollers are provided for pressing the paper sheets at the pressing member, the guide roller being rotatable in a feeding direction of the paper sheets, and wherein the guide rollers press on the paper sheets stored in the storage unit on both sides of each kicker roller.

2. The paper sheet handling machine according to claim 1, wherein the pressing member presses the paper sheets stored in the storage unit, at a point, other than a position just above the kicker roller.

3. The paper sheet handling machine according to claim 2, wherein the pressing member presses the paper sheets stored in the storage unit, on the side closer to the gate mechanism, relative to the kicker roller.

4. The paper sheet handling machine according to claim 1, wherein the pressing member includes a protrusion part protruding downward and configured to press the paper sheets stored in the storage unit.

5. The paper sheet handling machine according to claim 4, wherein protrusion parts press the paper sheets stored in the storage unit, on both sides of the feed roller.

6. The paper sheet handling machine according to claim 5, wherein a bottom end of each protrusion part is movable to a level below a top end of the feed roller, in a direction vertical to the feed out plane.

7. The paper sheet handling machine according to claim 1, further comprising:

an auxiliary roller provided alongside the feed roller and configured to rotate together with the feed roller; and a pressing roller provided in a position opposite to the auxiliary roller, the pressing roller being rotatable in a feeding direction of the paper sheets, wherein the pressing roller presses the paper sheets stored in the storage unit, between the pressing roller and the auxiliary roller.

8. The paper sheet handling machine according to claim 7, wherein the pressing roller is driven to rotate.

9. The paper sheet handling machine according to claim 1, wherein the pressing member is reciprocatable between a retracted position and a pressing position, and the pressing member constitutes a part of a side wall of the storage unit, to which the gate member is provided, when the pressing member takes the retracted position, while the pressing member presses, from above, the paper sheets stored in the storage unit, when taking the pressing position.

10. A paper sheet handling machine comprising:

a storage unit for storing therein paper sheets in a batch form;

a kicker roller provided to the storage unit, for providing drive force to the paper sheet located in the lowest position, among the paper sheets stored in the storage unit, in the batch form, by rotating;

a gate mechanism including two or more feed rollers are provided to the storage unit, and a gate member provided to be opposed to the feed-rollers, the gate mechanism being configured to grasp the paper sheet provided with the drive force by the kicker roller and to feed out the paper sheet along a feed out place;

a transport mechanism for transporting the paper sheet fed out by the gate mechanism;

a stacking unit for stacking therein the paper sheets transported by the transport mechanism; and a pressing member including a protrusion part protruding downward and configured to press the paper sheets stored in the storage unit;

wherein protrusion parts press the paper sheets stored in the storage unit, on both sides of each feed roller; and wherein a guide roller is provided for pressing the paper sheets, in a face of the pressing member, the guide roller being rotatable in a feeding direction of the paper sheets.

11. A paper sheet handling machine comprising:

a storage unit for storing therein paper sheets in a batch form;

a kicker roller provided to the storage unit, for providing drive force to the paper sheet located in the lowest position, among the paper sheets stored in the storage unit, in the batch form, by rotating;

a gate mechanism including a feed roller provided to the storage unit, and a gate member provided to be opposed to the feed-roller, the gate mechanism being configured to grasp the paper sheet provided with the drive force by the kicker roller and to feed out the paper sheet along a feed out plane;

a transport mechanism for transporting the paper sheet fed out by the gate mechanism;

a stacking unit for stacking therein the paper sheets transported by the transport mechanism; and a pressing member for pressing, from above, the paper sheets stored in the storage unit;

wherein a bottom end of the pressing member is located lower on the side closer to the gate mechanism than on the side closer to the kicker roller, in the direction vertical to the feed out plane, lower than the feed out plane, and wherein a guide roller is provided pressing the paper sheets, in a face of the pressing member, the guide roller being rotatable in a feeding direction of the paper sheets.

* * * * *